US009816302B2

(12) United States Patent
Shepherd

(10) Patent No.: US 9,816,302 B2
(45) Date of Patent: Nov. 14, 2017

(54) CONCEALED EXTERNAL HINGE WITH 180 DEGREE ROTATION

(71) Applicant: Siemens Industry, Inc., Alpharetta, GA (US)

(72) Inventor: Richard Shepherd, Sacramento, CA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/041,902

(22) Filed: Feb. 11, 2016

(65) Prior Publication Data

US 2017/0234046 A1 Aug. 17, 2017

(51) Int. Cl.

| | |
|---|---|
| ***E05D 15/32*** | (2006.01) |
| ***E05D 3/14*** | (2006.01) |
| ***E05D 11/00*** | (2006.01) |
| ***E05F 5/02*** | (2006.01) |
| ***E05F 5/00*** | (2017.01) |

(52) U.S. Cl.

CPC ..... *E05D 3/14* (2013.01); *E05D 3/142* (2013.01); *E05D 11/0018* (2013.01); *E05F 5/006* (2013.01); *E05F 5/02* (2013.01)

(58) Field of Classification Search

CPC .... E05D 3/06; E05D 3/12; E05D 3/14; E05D 3/142; E05D 3/16; E05D 3/125; E05D 3/127; E05D 5/062; E05D 5/006; E05D 5/02; E05D 11/0018; E06Y 2600/41; E06Y 2600/412; E06Y 2600/45; E06Y 2600/452; E06Y 2600/46; E05Y 2900/50; E05Y 2900/531; E05Y 2900/546; Y10T 16/547; Y10T 16/5474; Y10T 16/5475; Y10T 16/5476; Y10T 16/558; Y10T 16/5595

See application file for complete search history.

(56) References Cited

U.S. PATENT DOCUMENTS 2,179,113 A * 11/1939 Bates ..... E05D 3/02 16/235
2,570,479 A * 10/1951 Pollman ..... E05D 3/14 16/370
2,596,816 A * 5/1952 Lieberman ..... E05D 3/06 16/358
2,901,766 A * 9/1959 Marquis ..... E05D 3/147 16/370
3,600,742 A * 8/1971 Barger ..... E05D 3/12 16/366

(Continued)

FOREIGN PATENT DOCUMENTS

DE 102004029831 B3 1/2006

*Primary Examiner* — Chuck Mah

(57) ABSTRACT

An external hinge is provided for pivotally connecting a door to a sidewall while obtaining at least 180 degrees of opening movement or degree of rotation. The external hinge is substantially concealed behind the sidewall and the door in a fully closed position of the door. In one embodiment, the external hinge comprises a first curved arm extending between a first pivot pin of a first part mounted on an interior surface of the sidewall and a second pivot pin of a second part mounted on an interior surface of the door. The external hinge further comprises a second curved arm extending between a third pivot pin of the first part mounted on the interior surface of the sidewall and a fourth pivot pin of the second part mounted on the interior surface of the door.

20 Claims, 6 Drawing Sheets

(56) References Cited

U.S. PATENT DOCUMENTS

| | | | | | |
|---|---|---|---|---|---|
| 3,881,221 | A * | 5/1975 | Schmidt | E05D 3/186 | 16/273 |
| 3,886,627 | A * | 6/1975 | Bassan | E05D 3/186 | 16/360 |
| 4,658,473 | A * | 4/1987 | Schema | E05F 1/1261 | 16/286 |
| 5,282,293 | A * | 2/1994 | Pedoeem | E05D 3/12 | 16/342 |
| 6,402,270 | B1 * | 6/2002 | Frank | A47F 3/005 | 16/366 |
| 8,746,154 | B2 * | 6/2014 | Schoerkhuber | E05D 3/14 | 108/77 |
| 2007/0294860 | A1 * | 12/2007 | Hoffman | E05D 3/186 | 16/368 |
| 2008/0289146 | A1 * | 11/2008 | Chen | E05D 3/186 | 16/372 |
| 2015/0259960 | A1 * | 9/2015 | Smith | E05D 3/147 | 16/250 |

* cited by examiner

CONCEALED EXTERNAL HINGE WITH 180 DEGREE ROTATION

BACKGROUND

1. Field

Aspects of the present invention generally relate to hinges and more specifically relates to external hinges mounted on surfaces of a sidewall and a door which hide the hinge inside the door.

2. Description of the Related Art

A variety of hinges are used in doors for appliances and cabinets to meet a host of needs. From a fully open position to a fully closed position the movement of hinges is generally limited to approximately 180°.

Often hinges are mounted on surfaces of the cabinet and doors, which detracts from the aesthetics of the product. Therefore, it is desirable to hide part of the hinge inside the door. However, even in a hidden door hinge the hinge pins can be seen from the front when the door is closed. Unauthorized persons may be tempted to cut the exposed hinge pins to break into the door.

In addition, a hinge may be needed of an extremely simple and inexpensive construction, which is composed of few readily assembled parts. Such a door hinge may permit the door being swung to full open position but may not be fully invisible. However, there is a need for a rail vehicle side skirt to open 180 degrees but have no visible exterior hinge. More particularly, an invisible hinge may need to entirely conceal when the door is closed, and present a neat, compact appearance when the door is open.

In the past there was either a concealed single pivot hinge that allowed 130-140 degrees of opening or a typical door hinge visible on the exterior to obtain 180 degrees of opening.

Therefore, there is a need for improvements in hinges for applications such as external hinges which are concealed.

SUMMARY

Briefly described, aspects of the present invention relate to a concealed hinge configured as an invisible hinge that entirely hides itself when the door is closed, and present a neat, compact appearance when the door is open. In particular, a concealed multi-pivot hinge that allows 180 degrees of opening or movement is provided to be mounted on a sidewall and a door. For example, a concealed hinge having four pivot points and two connecting links is provided to obtain 180 degrees of opening. One of ordinary skill in the art appreciates that such a concealed multi-pivot hinge can be configured to be installed in different environments where an external hinge is needed, for example, in a door of a sidewall or a side skirt of a rail vehicle.

In accordance with one illustrative embodiment of the present invention, an external hinge for pivotally connecting a door to a sidewall is provided. The external hinge comprises a first curved arm extending between a first pivot pin of a first part mounted on an interior surface of the sidewall and a second pivot pin of a second part mounted on an interior surface of the door. The first pivot pin and the second pivot pin are mounted rotatably so as to allow the door to pivot between a fully open position and a fully closed position relative to a door opening. The external hinge further comprises a second curved arm extending between a third pivot pin of the first part mounted on the interior surface of the sidewall and a fourth pivot pin of the second part mounted on the interior surface of the door. The third pivot pin and the fourth pivot pin are mounted rotatably so as to allow the door to pivot between the fully open position and fully closed position. The external hinge is substantially concealed behind the sidewall and the door in the fully closed position of the door.

In accordance with another illustrative embodiment of the present invention, an external concealed hinge movable to define a door opening is provided. The external concealed hinge comprises a first movable link having first and second ends and a second movable link having first and second ends. While the first end of the first movable link is coupled to a sidewall and the second end of the first movable link is coupled to a door, the first end of the second movable link is coupled to the sidewall and the second end of the second movable link is coupled to the door. The second movable link is inter-digitally disposed as a contiguous set of links relative to the first movable link and is configured to move independently of the first movable link. The second movable link is in a sliding contact with the first movable link during motion of the external concealed hinge. The first movable link and the second movable link being substantially hidden behind the sidewall and the door in a fully closed position of the door relative to the door opening.

In accordance with yet another illustrative embodiment of the present invention, a method of hinging a door to a sidewall with a hinge is provided. The method comprises linking a first part of the hinge with a second part of the hinge by a first movable link having first and second ends, the first end of the first movable link is coupled to the sidewall and the second end of the first movable link is coupled to the door and linking the first part of the hinge with the second part of the hinge by a second movable link having first and second ends, the first end of the second movable link is coupled to the sidewall and the second end of the second movable link is coupled to the door, wherein the second movable link is inter-digitally disposed as a contiguous set of links relative to the first movable link to move independently of the first movable link, wherein the second movable link is in a sliding contact with the first movable link during motion of the hinge, wherein the first movable link and the second movable link being substantially hidden behind the sidewall and the door in a fully closed position of the door relative to a door opening.

DETAILED DESCRIPTION

To facilitate an understanding of embodiments, principles, and features of the present invention, they are explained hereinafter with reference to implementation in illustrative embodiments. In particular, they are described in the context of being an external concealed hinge configured for hinging a door to a sidewall while obtaining 180 degrees of opening or degree of rotation of the external concealed hinge. For example, such a concealed hinge includes four pivot points and two connecting links. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
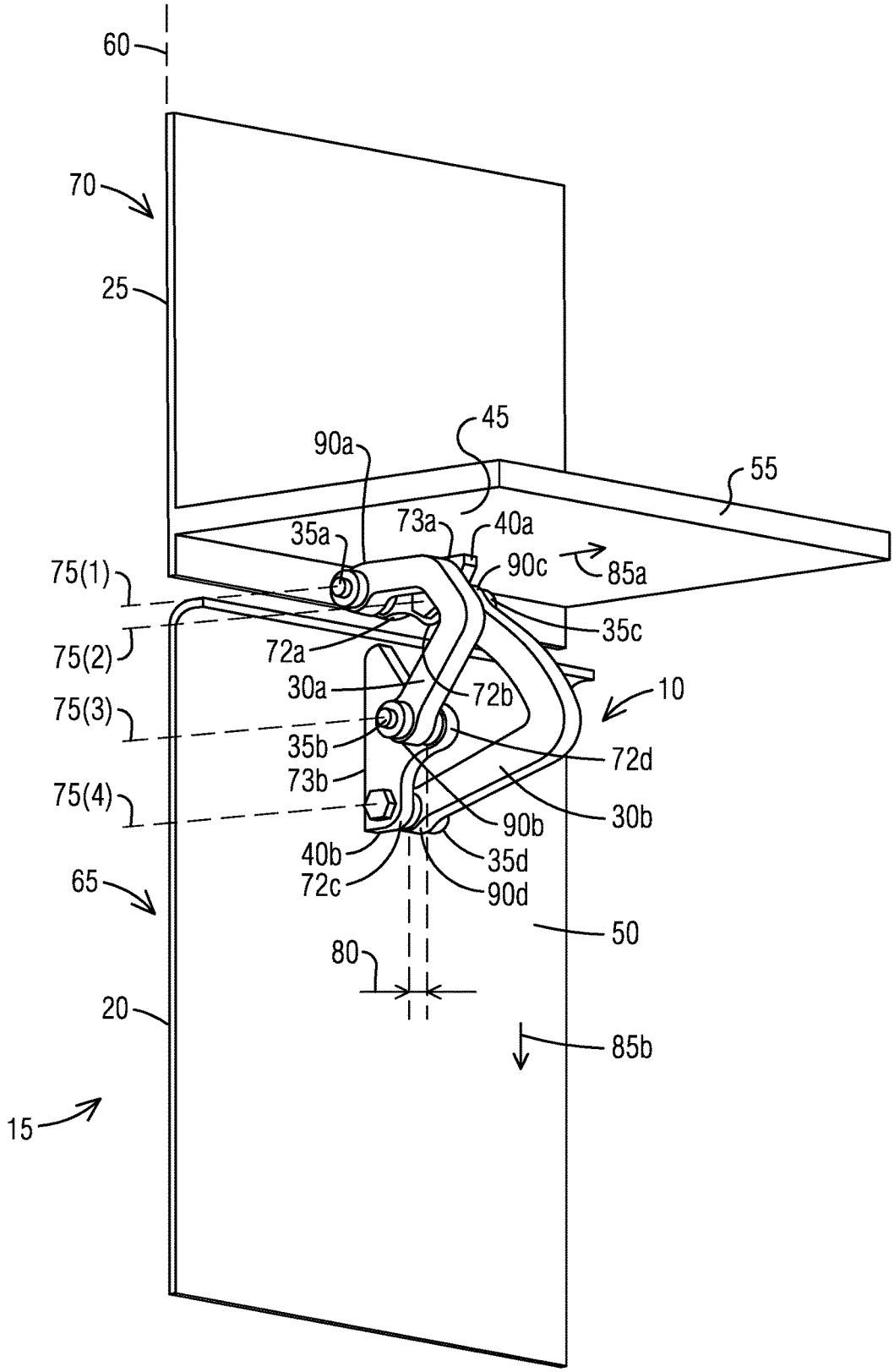
FIG. 1 illustrates an isometric view of a concealed hinge in a fully closed position in accordance with an exemplary embodiment of the present invention.

Consistent with one embodiment of the present invention, FIG. 1 represents a concealed hinge 10 movable to define a door opening in a fully closed position 15. The concealed hinge 10 is configured for hinging a door 20 to a sidewall 25 while obtaining 180 degrees of opening or degree of rotation of the concealed hinge 10. When the door 20 is rotated toward the sidewall 25 in closing the concealed hinge 10, the door 20 will fold over onto the sidewall 25. The final position of the various members and links is apparent in FIG. 1, the entire mechanism of the concealed hinge 10 being invisible when the door 20 is closed.

The concealed hinge 10 is a four pivot point configuration with first and second movable connecting links which are shown as first and second curved arms 30*a*, 30*b* in accordance with an exemplary embodiment of the present invention. By utilizing the four pivot points in place of one, an effective pivot (instantaneous center of rotation) is formed that has a very tunable path. Elevating this effective pivot throughout a stroke allows the door 20 to move outward during its rotation and come to rest in a desired final position such as a fully open position.

In one embodiment, the concealed hinge 10 may be made of a metal, such as stainless steel. However, one skilled in the pertinent art would recognize that other suitable materials may be used based on a particular application and/or a desired objective without deviating from the spirit and scope of the present invention.

As used herein, the "concealed hinge" refers to a single or multi-pivot external hinge, as described herein, which corresponds to an invisible hinge used for hinging a door to a sidewall that allows at least 180 degrees of opening or degree of rotation and stays completely hidden from view when a door is in a fully closed position. It should be appreciated that several components may be included in the "multi-pivot external hinge." The "multi-pivot external hinge," may be capable of operating to provide a hinging function based on its features such as a degree of rotation, construction type, pivot type or pivot point or pin number, and other structural features.

As shown in FIG. 1, the concealed hinge 10 is provided for pivotally connecting the door 20 to the sidewall 25. The concealed hinge 10 comprises the first curved arm 30*a* extending between a first pivot pin 35*a* of a first part 40*a* mounted on an interior surface 45 of the sidewall 25 and a second pivot pin 35*b* of a second part 40*b* mounted on an interior surface 50 of the door 20. The first pivot pin 35*a* and the second pivot pin 35*b* are mounted rotatably so as to allow the door 20 to pivot between a fully open position and the fully closed position 15 relative to a door opening.

The concealed hinge 10 further comprises the second curved arm 30*b* extending between a third pivot pin 35*c* of the first part 40*a* mounted on the interior surface 45 of the sidewall 25 and a fourth pivot pin 35*d* of the second part 40*b* mounted on the interior surface 50 of the door 20. The third pivot pin 35*c* and the fourth pivot pin 35*d* are mounted rotatably so as to allow the door 20 to pivot between the fully open position and fully closed position 15. The concealed hinge 10 is substantially concealed behind the sidewall 25 and the door 20 in the fully closed position 15 of the door 20.

The first part 40*a* of the concealed hinge 10 is coupled to a base plate 55 extending transversely from a horizontal plane 60 of the sidewall 25. The first part 40*a* may be affixed to the base plate 55 by any suitable fastening means, for example, screws, rivets, adhesive, welding, or the like, any of which constitute means for affixing a part to the base plate 55. An exterior surface 65 of the door 20 aligns with an exterior surface 70 of the sidewall 25 in the horizontal plane 60 when the door 20 is in the fully closed position 15.

The second part 40*b* of the concealed hinge 10 is coupled to the door 20 which is aligned substantially flush with the sidewall 25 in the horizontal plane 60 when the door 20 is in the fully closed position 15. The second part 40*b* may be affixed to the door 20 by any suitable fastening means, for example, screws, rivets, adhesive, welding, or the like, any of which constitute means for affixing a part to the door 20.

The first part 40*a* of the concealed hinge 10 includes a first hole (not seen) to receive the first pivot pin 35*a* and a second hole (not seen) to receive the third pivot pin 35*c*. The first and the second holes are aligned longitudinally and separated by a distance. The first and the second holes are located at different heights relative to a base of the first part 40*a*.

The second part 40*b* of the concealed hinge 10 includes a third hole (not seen) to receive the second pivot pin 35*b* and a fourth hole (not seen) to receive the fourth pivot pin 35*d*. The third and the fourth holes are aligned longitudinally and separated by a distance. The third and the fourth holes are located at different heights relative to a base of the second part 40*b*.

More specifically, the first part 40*a* includes a first flange 72*a* and a second flange 72*b* each with a hole to receive a corresponding pivot pin. The first flange 72*a* and the second flange 72*b* project outwardly from an edge of a first base 73*a* of the first part 40*a*. The holes through the first flange 72*a* and the second flange 72*b* are aligned with one another and disposed at spaced-apart locations.

Likewise, the second part 40*b* includes a third flange 72*c* and a fourth flange 72*d* each with a hole to receive a pivot pin. The third flange 72*c* and the fourth flange 72*d* project outwardly from an edge of a second base 73*b* of the second part 40*b*. The holes through the third flange 72*c* and the fourth flange 72*d* are aligned with one another and disposed at spaced-apart locations.

FIG. 1 shows one possible arrangement of hinge pins including the first pivot pin 35*a*, the second pivot pin 35*b*, the third pivot pin 35*c* and the fourth pivot pin 35*d*. In the embodiment of FIG. 1, the hinge pins including the first pivot pin 35*a*, the second pivot pin 35*b*, the third pivot pin 35*c* and the fourth pivot pin 35*d* extend a thickness of the first curved arm 30*a* or the second curved arm 30*b* and a thickness of the first flange 72*a* or the second flange 72*b* or a thickness of the third flange 72*c* and the fourth flange 72*d*, respectively.

In the hinge pins including the first pivot pin 35*a*, the second pivot pin 35*b*, the third pivot pin 35*c* and the fourth pivot pin 35*d* the action of hinge is provided by use of suitable brushings which may be made of, e.g., plastic such as Nylon material. This may enable a smooth hinging motion and desirably control resistance to motion.

Consistent with one embodiment, the first pivot pin 35*a*, the second pivot pin 35*b*, the third pivot pin 35*c* and the fourth pivot pin 35*d* pivot about a respective axis 75(1-4) of hinging parallel to each other.

The first curved arm 30*a* is curved substantially about a radius centered at a midway point between the first pivot pin 35*a* of the first part 40*a* and the second pivot pin 35*b* of the second part 40*b*. The second curved arm 30*b* is curved substantially about a radius centered at a midway point between the third pivot pin 35*c* of the first part 40*a* and the fourth pivot pin 35*d* of the second part 40*b*. In one embodiment, the second curved arm 30*b* is longer in length than the first curved arm 30*a*.

According to one embodiment, the first curved arm 30*a* and the second curved arm 30*b* are offset with each other by a thickness 80 of the first and second parts 40*a*, 40*b* and pivotally connected to each other adjacent their point of connection with the first and second parts 40*a*, 40*b*. The first curved arm 30*a* and the second curved arm 30*b* are disposed laterally to each other in a first direction 85*a* on a first end of the concealed hinge 10 and disposed laterally to each other in a second direction 85*b* on a second end of the concealed hinge 10 such that the first direction 85*a* is perpendicular to the second direction 85*b*.

The first curved arm 30*a* as a first movable link has first and second ends 90*a*, 90*b*. The first end 90*a* of the first movable link is coupled to the sidewall 25 and the second end 90*b* of the first movable link is coupled to the door 20. The second curved arm 30*b* as a second movable link has first and second ends 90*c*, 90*d*. The first end 90*c* of the second movable link is coupled to the sidewall 25 and the second end 90*d* of the second movable link is coupled to the door 20.

The second movable link is overlappingly disposed as a pair of links relative to the first movable link and is configured to rotate independently of the first movable link. The second movable link is in a sliding contact with the first movable link during motion of the concealed hinge 10. The first movable link and the second movable link are substantially hidden behind the sidewall 25 and the door 20 in the fully closed position 15 of the door 20 relative to the door opening.

The first movable link includes the first and second pivot pins 35*a*, 35*b* being substantially hidden behind the sidewall 25 and the door 20 in the fully closed position 15 of the door 20. The second movable link includes the third and fourth pivot pins 35*c*, 35*d* being substantially hidden behind the sidewall 25 and the door 20 in the fully closed position 15 of the door 20.

The concealed hinge 10 may be used in doors for appliances and cabinets to meet a variety of needs. From a fully open position to the fully closed position 15 the movement or degree of rotation of the concealed hinge 10 is generally approximately 180°. The concealed hinge 10 may be used for a rail vehicle side skirt to open 180 degrees while have no visible exterior hinge parts showing.

While the concealed hinge 10 may hide parts of the hinge behind the door 20, it may also provide an extremely simple and inexpensive construction, which is composed of few readily assembled parts as it needs only two movable connecting links and four pivot points. The concealed hinge 10 with two assembled parts and two movable connecting links having four pivot points may permit the door 20 being swung to the fully closed position 15 while stay fully invisible. In particular, this simple configuration of the concealed hinge 10 may entirely conceal itself when the door 20 is closed, and present a neat, compact appearance when the door 20 is open.

Accordingly, a concealed multi-pivot hinge such as the concealed hinge 10 allows 180 degrees of opening while not visible on the exterior. However, the concealed hinge 10 may provide various hinge configurations for disparate applications such as external hinges which are needed to be hidden or invisible.

Figure 2:
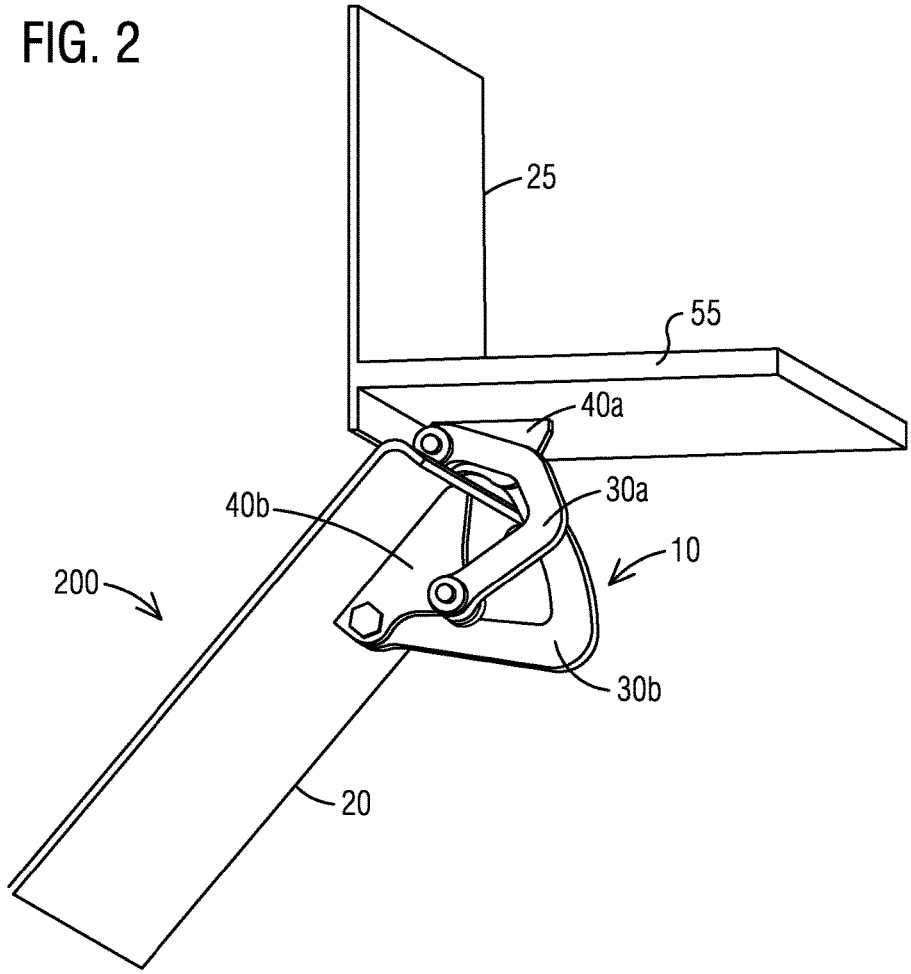
FIG. 2 illustrates an isometric view of the concealed hinge of FIG. 1 in a quarter open position in accordance with an exemplary embodiment of the present invention.
Figure 3:
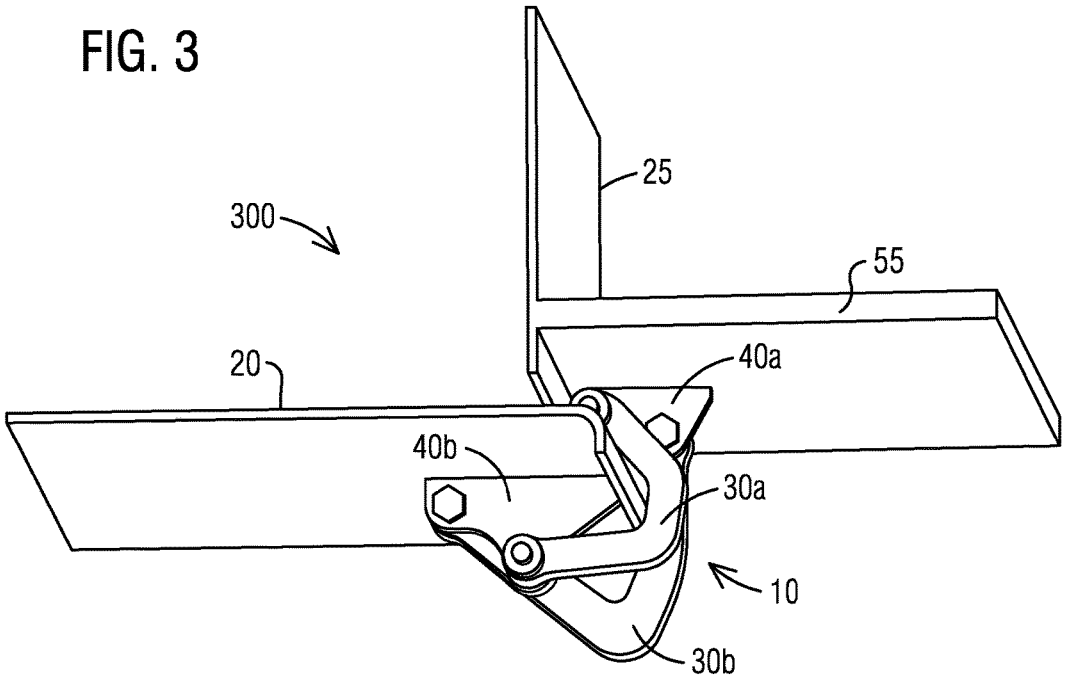
FIG. 3 illustrates an isometric view of the concealed hinge of FIG. 1 in a half open position in accordance with an exemplary embodiment of the present invention.
Figure 4:
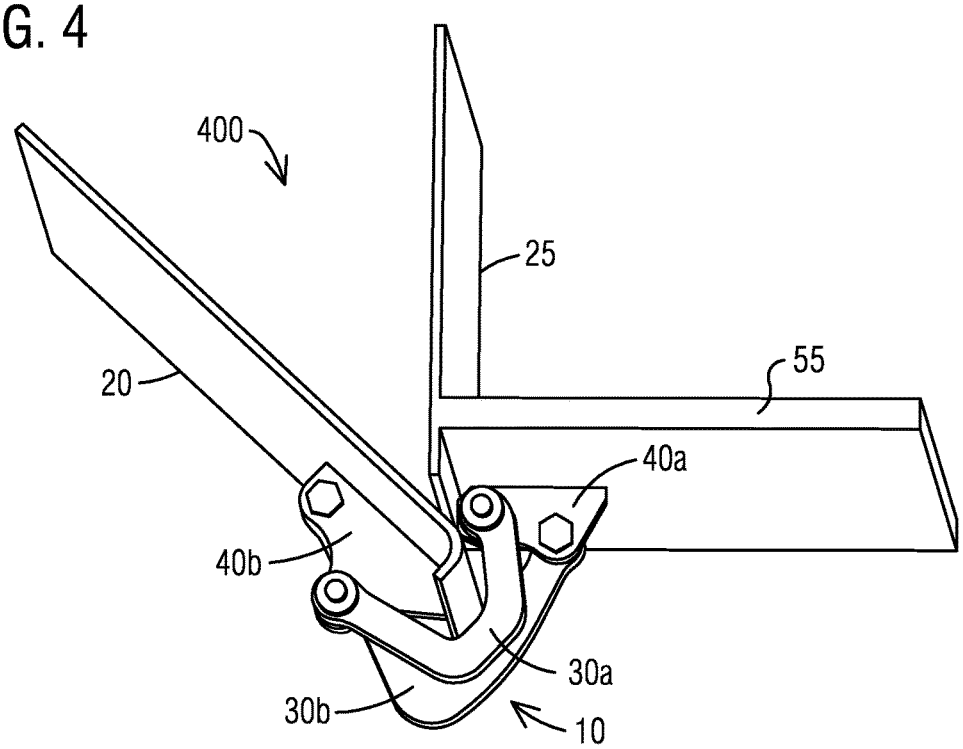
FIG. 4 illustrates an isometric view of the concealed hinge of FIG. 1 in a three-fourths open position in accordance with an exemplary embodiment of the present invention.

Referring to FIG. 2, it illustrates an isometric view of the concealed hinge 10 of FIG. 1 in a quarter open position 200 in accordance with an exemplary embodiment of the present invention. Turning now to FIG. 3, it illustrates an isometric view of the concealed hinge 10 of FIG. 1 in a half open position 300 in accordance with an exemplary embodiment of the present invention. FIG. 4 illustrates an isometric view of the concealed hinge 10 of FIG. 1 in a three-fourths open position 400 in accordance with an exemplary embodiment of the present invention.

Figure 5:
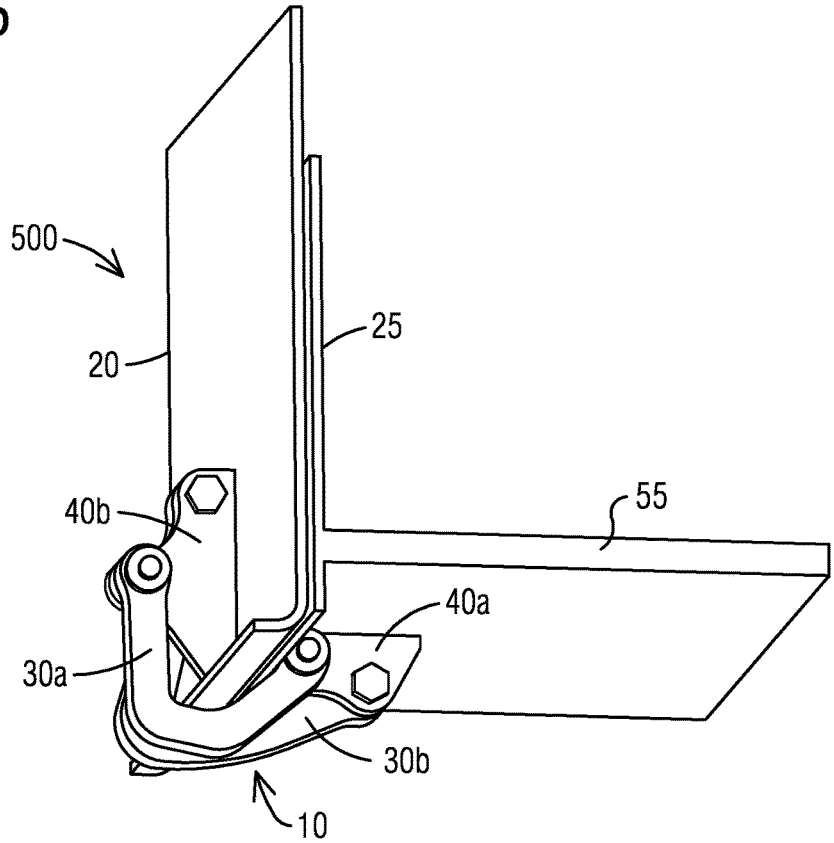
FIG. 5 illustrates an isometric view of the concealed hinge of FIG. 1 in a fully open position in accordance with an exemplary embodiment of the present invention.

As shown in FIG. 5, it illustrates an isometric view of the concealed hinge 10 of FIG. 1 in a fully open position 500 in accordance with an exemplary embodiment of the present invention. The concealed hinge 10 provides a hinging function that allows the door 20 to pivot approximately 180° between the fully closed position 15, shown in FIG. 1, and the fully open position, shown in FIG. 5.

Figure 6A:
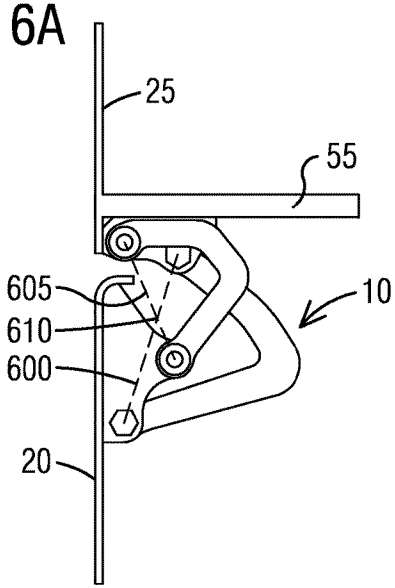
FIGS. 6A-6F illustrate side views of the concealed hinge of FIG. 1 to show how the concealed hinge achieves the motion of an external hinge while remaining concealed in accordance with an exemplary embodiment of the present invention.

As seen in FIGS. 6A-6F, they illustrate side views of the concealed hinge 10 of FIG. 1 to show how the concealed hinge 10 achieves the motion of an external hinge while remaining concealed in accordance with an exemplary embodiment of the present invention. In FIG. 6A, two intersecting lines 600 and 605 are shown to indicate the intersection of the lines 600, 605 as an effective center of rotation or an effective pivot point 610 at that particular point in the motion of the concealed hinge 10 through a stroke.

Figure 6B:
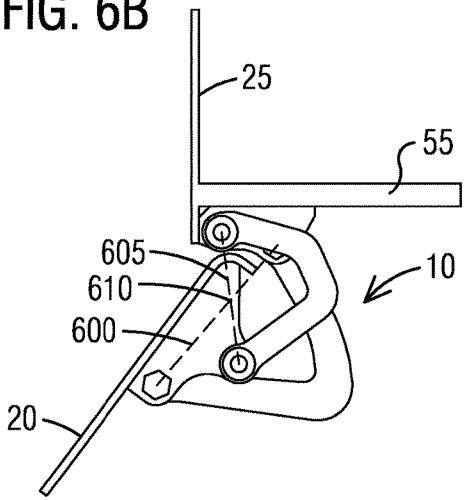
Figure 6C:
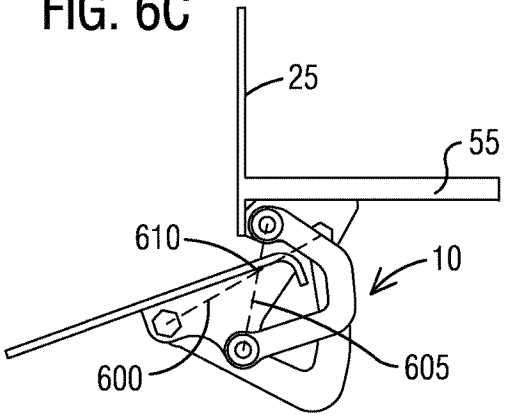
Figure 6D:
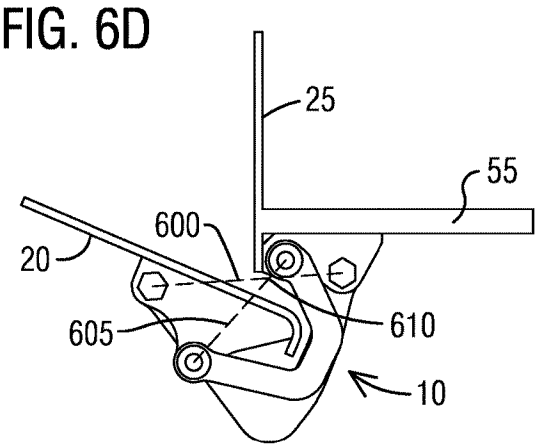
Figure 6E:
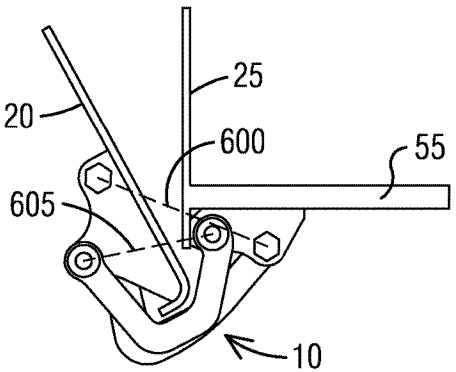
Figure 6F:
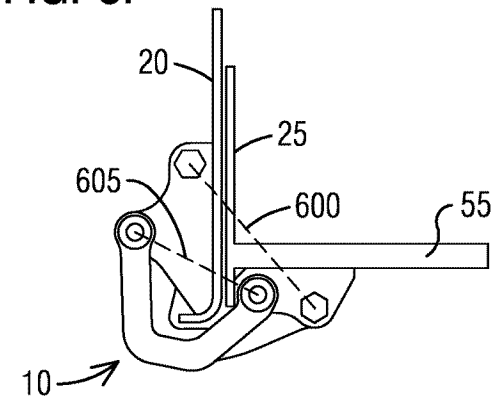

As can be seen from FIGS. 6A-6C, the effective pivot point 610 exists on the interior side of the door 20 until the door 20 is less than half way open. As can be seen from FIGS. 6D-6F, the effective pivot point 610 exists on the exterior side of the door 20 through more than the last half of the door 20 opening. By guiding the effective pivot point 610 to dwell exterior relative to the door 20 through a majority of the stroke, a net result is similar to having an actual external hinge.

Figure 7:
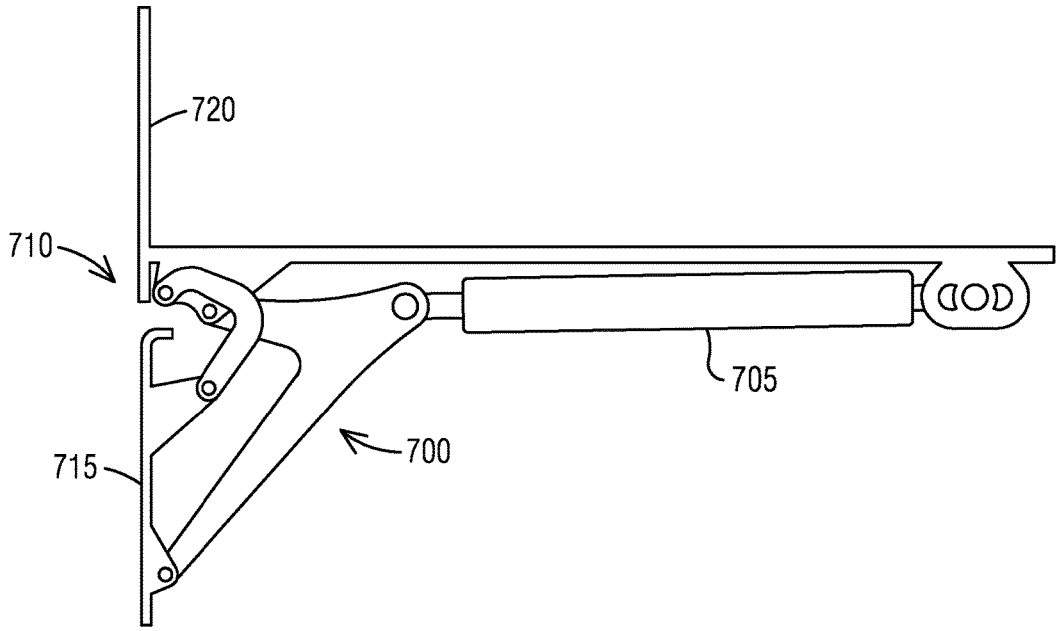
FIG. 7 illustrates an isometric view of a concealed hinge with a gas strut in a fully closed position in accordance with an exemplary embodiment of the present invention.

In FIG. 7, an isometric view of a concealed hinge 700 with a gas strut 705 in a fully closed position 710 is illustrated in accordance with an exemplary embodiment of the present invention. A concealed hinge can be independent of a gas strut (if desired) as shown in FIG. 1 or integrated with a gas strut as shown in FIG. 7. The gas strut 705 may support the weight of a door 715 while it is open. The concealed hinge 700 may hinge the door 715 to a side wall 720 which may be a side skirt of a rail vehicle.

In one embodiment, the gas strut 705 is a type of spring that, unlike a typical metal spring, uses a compressed gas, contained in a cylinder and compressed by a piston, to exert a force. The gas strut 705 (sometimes called "gas springs" or "gas shocks") use compressed nitrogen to provide a force and a hydraulic circuit to provide the dampening (removes the "snap effect"). Although, the gas strut 705 may allow for minor movement but a gas strut is not intended as an assist in lifting or moving.

Figure 8:
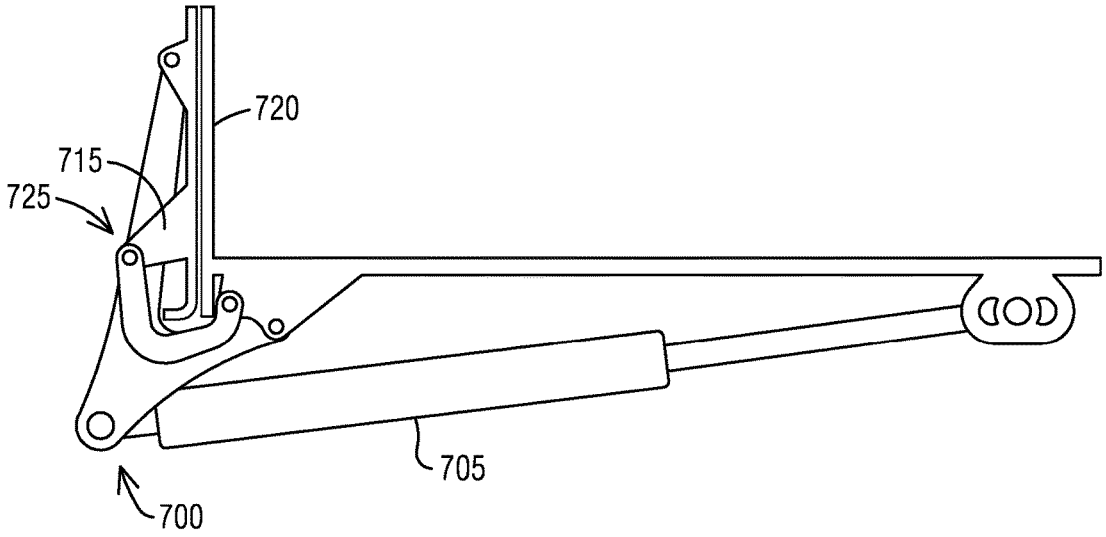
FIG. 8 illustrates an isometric view of the concealed hinge of FIG. 12 in a fully open position in accordance with an exemplary embodiment of the present invention.

With regard to FIG. 8, it illustrates an isometric view of the concealed hinge 700 of FIG. 7 in a fully open position 725 in accordance with an exemplary embodiment of the present invention. The concealed hinge 700 may be used for any application in which a door swings open/shut. For example, the concealed hinge 700 may be deployed in opening of the side skirt of a rail vehicle.

Figure 9:
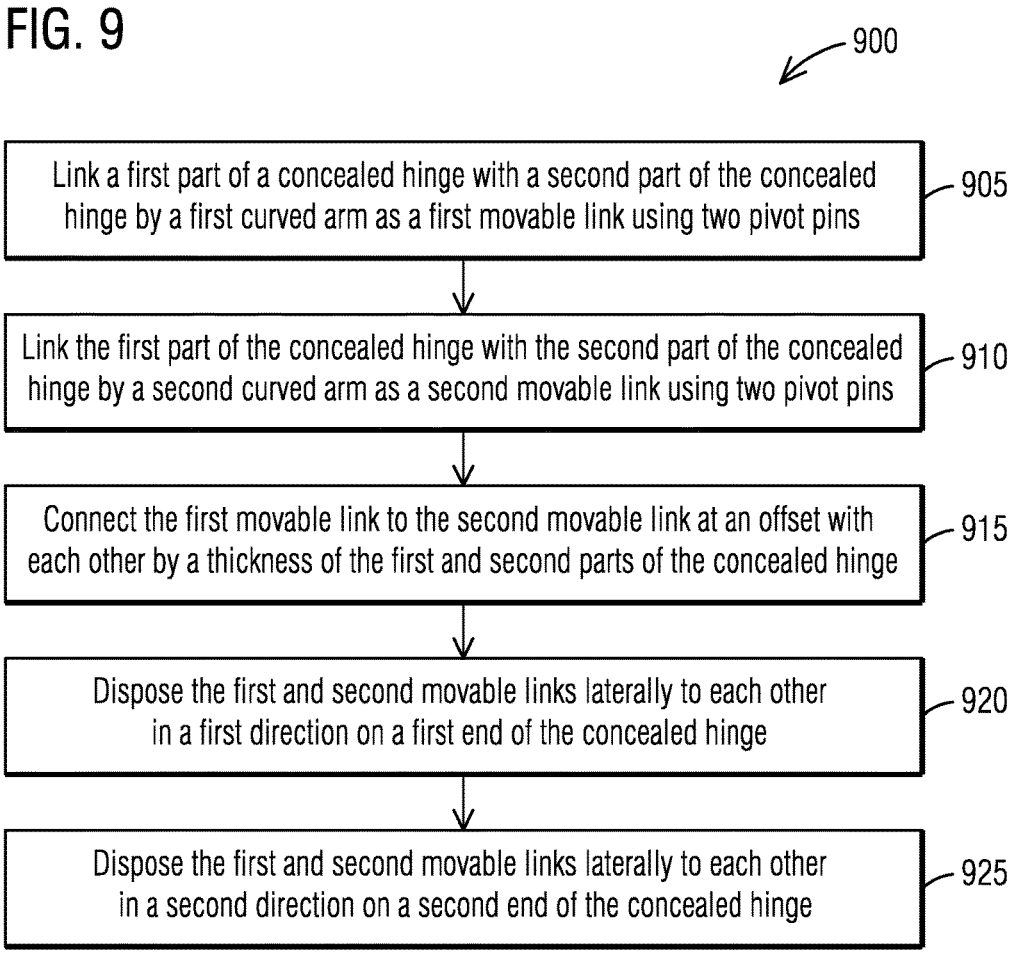
FIG. 9 illustrates a flow chart of a method of hinging a door to a sidewall with a concealed hinge in accordance with an exemplary embodiment of the present invention.

With respect to FIG. 9, it illustrates a flow chart of a method 900 of hinging the door 20 to the sidewall 25 with the concealed hinge 10 in accordance with an exemplary embodiment of the present invention. Reference is made to the elements and features described in FIGS. 1-8. It should be appreciated that some steps are not required to be performed in any particular order, and that some steps are optional.

At step 905, the method 900 includes linking the first part 40*a* of the concealed hinge 10 with the second part 40*b* of the concealed hinge 10 by the first curved arm 30*a* such as a first movable link having first and second ends. At step 910, the method 900 includes linking the first part 40*a* of the concealed hinge 10 with the second part 40*b* of the concealed hinge 10 by the second curved arm 30*b* as a second movable link having first and second ends.

In step 915, the first movable link and the second movable link are connected at an offset with each other by a thickness of the first part 40*a* mounted on an interior surface of the sidewall 25 and the second part 40*b* mounted on an interior surface of the door 20. At step 920, the first movable link and the second movable link are disposed laterally to each other in a first direction on a first end of the concealed hinge 10. At step 925, the first movable link and the second movable link are disposed laterally to each other in a second direction on a second end of the concealed hinge 10 such that the first direction is perpendicular to the second direction.

The techniques described herein can be particularly useful for a concealed four point pivoted external hinge with two movable connecting links and two assembled parts. While particular embodiments are described in terms of multi-pivot hinge with multiple connecting links, the techniques described herein are not limited to multi-pivot hinge with multiple connecting links but can also use springs or sliding rollers to achieve a desired effective pivot point, as described earlier with respect to FIGS. 6A-6F.

External concealed hinges according to the embodiments of the present invention may be used to connect two parts for which one of the parts is attached to the other in normal use. For example, an enclosure may have a door designed to be attached to a wall, skirt, or the like. External concealed hinges according to the embodiments of the present invention may be used to attach doors to enclosures of any kind, to attach doors to other structures or, in general, to hingedly attach any two parts where an external hinge is desired in an invisible configuration while providing at least 180 degrees of degree of rotation.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. In combination with a sidewall and a door, an external hinge for pivotally connecting the door to the sidewall, comprising:

a first curved arm extending between a first pivot pin of a first part mounted on an interior surface of the sidewall and a second pivot pin of a second part mounted on an interior surface of the door, the first pivot pin and the second pivot pin mounted rotatably so as to allow the door to pivot between a fully open position and a fully closed position relative to a door opening; and a second curved arm extending between a third pivot pin of the first part mounted on the interior surface of the sidewall and a fourth pivot pin of the second part mounted on the interior surface of the door, the third pivot pin and the fourth pivot pin mounted rotatably so as to allow the door to pivot between the fully open position and fully closed position, wherein the external hinge is substantially concealed behind the sidewall and the door in the fully closed position of the door, wherein the first curved arm and the second curved arm are offset with each other by a thickness of the first and second parts and pivotally connected to each other adjacent their point of connection with the first and second parts such that from a fully open position to a fully closed position movement or degree of rotation of the external hinge is about 180°.

2. The external hinge of claim 1, wherein the first part is coupled to a base plate extending transversely from a horizontal plane of the sidewall.

3. The external hinge of claim 2, wherein an exterior surface of the door aligns with an exterior surface of the sidewall in the horizontal plane when the door is in the fully closed position.

4. The external hinge of claim 3, wherein the second part is coupled to the door which is aligned substantially flush with the sidewall in the horizontal plane when the door is in the fully closed position.

5. The external hinge of claim 1, wherein the first curved arm is curved substantially about a radius centered at a midway point between the first pivot pin of the first part and the second pivot pin of the second part.

6. The external hinge of claim 1, wherein the second curved arm is curved substantially about a radius centered at a midway point between the third pivot pin of the first part and the fourth pivot pin of the second part.

7. The external hinge of claim 1, wherein the second curved arm is longer in length than the first curved arm.

8. The external hinge of claim 1, wherein the first pivot pin, the second pivot pin, the third pivot pin and the fourth pivot pin pivot about a respective axis of hinging parallel to each other.

9. The external hinge of claim 1, wherein the first curved arm and the second curved arm are disposed laterally to each other in a first direction on a first end of the hinge and disposed laterally to each other in a second direction on a second end of the hinge such that the first direction is perpendicular to the second direction.

10. The external hinge of claim 1, wherein the external hinge remains concealed by having an effective pivot point at a particular point in the motion of the external hinge through a stroke such that the effective pivot point exists on an interior side of the door until the door is less than half way open and the effective pivot point exists on an exterior side of the door through more than the last half of the door opening.

11. An external concealed hinge movable to define a door opening, the external concealed hinge comprising:

a first movable link having first and second ends, the first end of the first movable link is coupled to a sidewall and the second end of the first movable link is coupled to a door;

a second movable link having first and second ends, the first end of the second movable link is coupled to the sidewall and the second end of the second movable link is coupled to the door;

a first part mounted on an interior surface of the sidewall; and a second part mounted on an interior surface of the door, wherein the first movable link and the second movable link are offset with each other by a thickness of the first and second parts and pivotally connected to each other adjacent their point of connection with the first and second parts such that from a fully open position to a fully closed position movement or degree of rotation of the external concealed hinge is about 180°, wherein the second movable link is overlappingly disposed as a contiguous pair of links relative to the first movable link and is configured to rotate independently of the first movable link, wherein the second movable link is in a sliding contact relationship with the first movable link during motion of the external concealed hinge, and wherein the first movable link and the second movable link being substantially hidden behind the sidewall and the door in a fully closed position of the door relative to the door opening.

12. The external concealed hinge of claim 11, wherein the first movable link includes first and second pivot pins being substantially hidden behind the sidewall and the door in the fully closed position of the door.

13. The external concealed hinge of claim 12, wherein the second movable link includes third and fourth pivot pins being substantially hidden behind the sidewall and the door in the fully closed position of the door.

14. The external concealed hinge of claim 13, wherein the first pivot pin, the second pivot pin, the third pivot pin and the fourth pivot pin pivot about a respective axis of hinging parallel to each other.

15. The external concealed hinge of claim 11, wherein the second movable link is longer in length than the first movable link.

16. The external concealed hinge of claim 11, wherein the first movable link and the second movable link are disposed laterally to each other in a first direction on a first end of the external concealed hinge and the first movable link and the second movable link are disposed laterally to each other in a second direction on a second end of the external concealed hinge such that the first direction is perpendicular to the second direction.

17. The external concealed hinge of claim 11, wherein the external concealed hinge remains concealed by having an effective pivot point at a particular point in the motion of the external concealed hinge through a stroke such that the effective pivot point exists on an interior side of the door until the door is less than half way open and the effective pivot point exists on an exterior side of the door through more than the last half of the door opening.

18. A method of hinging a door to a sidewall with a hinge, the method comprising:

linking a first part of the hinge with a second part of the hinge by a first movable link having first and second ends, the first end of the first movable link is coupled to the sidewall and the second end of the first movable link is coupled to the door;

linking the first part of the hinge with the second part of the hinge by a second movable link having first and second ends, the first end of the second movable link is coupled to the sidewall and the second end of the second movable link is coupled to the door; and connecting the first movable link and the second movable link at an offset with each other by a thickness of the first part mounted on an interior surface of the sidewall and the second part mounted on an interior surface of the door such that from a fully open position to a fully closed position movement or degree of rotation of the hinge is about 180°, wherein the second movable link is overlappingly disposed as a pair of links relative to the first movable link to rotate independently of the first movable link, and wherein the second movable link is in a sliding relationship with the first movable link during motion of the hinge, wherein the first movable link and the second movable link being substantially hidden behind the sidewall and the door in a fully closed position of the door relative to a door opening.

19. The method of claim 18, further comprising:

disposing laterally the first movable link and the second movable link to each other in a first direction on a first end of the hinge; and disposing laterally the first movable link and the second movable link to each other in a second direction on a second end of the hinge such that the first direction is perpendicular to the second direction, wherein the first movable link and the second movable link are pivotally connected to each other adjacent their point of connection with the first and second parts and wherein the second movable link is longer in length than the first movable link.

20. The method of claim 18, wherein the hinge remains concealed by having an effective pivot point at a particular point in the motion of the hinge through a stroke such that the effective pivot point exists on an interior side of the door until the door is less than half way open and the effective pivot point exists on an exterior side of the door through more than the last half of the door opening.

* * * * *